US009959804B1

(12) United States Patent
Kuang et al.

(10) Patent No.: US 9,959,804 B1
(45) Date of Patent: May 1, 2018

(54) MURA COMPENSATION METHOD FOR DISPLAY PANEL

(71) Applicant: Shenzhen China Star Optoelectronics Technology Co., Ltd., Shenzhen (CN)

(72) Inventors: Jimu Kuang, Shenzhen (CN); Yichien Wen, Shenzhen (CN)

(73) Assignee: SHENZHEN CHINA STAR OPTOELECTRONICS TECHNOLOGY CO., LTD., Shenzhen. Guangdong (CN)

( * ) Notice: Subject to any disclaimer, the term of this patent is extended or adjusted under 35 U.S.C. 154(b) by 167 days.

(21) Appl. No.: 15/112,427

(22) PCT Filed: May 26, 2016

(86) PCT No.: PCT/CN2016/083410
§ 371 (c)(1),
(2) Date: Jul. 19, 2016

(87) PCT Pub. No.: WO2017/177514
PCT Pub. Date: Oct. 19, 2017

(30) Foreign Application Priority Data

Apr. 15, 2016 (CN) ..... 2016 1 0235645

(51) Int. Cl.
*G06G 3/00* (2006.01)
*G09G 3/20* (2006.01)

(52) U.S. Cl.
CPC ... *G09G 3/2092* (2013.01); *G09G 2320/0233* (2013.01); *G09G 2320/0626* (2013.01)

(58) Field of Classification Search
CPC ..... G09G 3/2092; G09G 3/3607; G09G 2300/0465; G09G 2320/0233; G09G 2320/0271
See application file for complete search history.

(56) References Cited

U.S. PATENT DOCUMENTS

2014/0320521 A1* 10/2014 Oh ..... G09G 5/02 345/601
2015/0206276 A1* 7/2015 Jung ..... G09G 5/00 345/561
2015/0256929 A1* 9/2015 Ikram ..... H04M 3/00 381/66

(Continued)

*Primary Examiner* — Kevin M Nguyen
(74) *Attorney, Agent, or Firm* — Leong C. Lei

(57) ABSTRACT

The invention provides a Mura compensation method for display panel, which extracts the luminance information of a grayscale b other than the lowest grayscale from the inputted image through an image console, generates a Mura value index table for 0 to the lowest grayscale; uses linearly interpolation calculate the Mura values for the remaining grayscales; determines the inputted data signal; for low grayscale image smaller than the lowest grayscale, searches the index table for Mura value to perform Mura compensation to make the compensated grayscale larger than the lowest grayscale; for dynamic image, uses linear interpolation to calculate the Mura value corresponding to the inputted data signal; and for static image, uses non-linear interpolation to calculate the Mura value corresponding to the inputted data signal. As such, the Mura compensation effect is improved for static and low grayscale images; moreover, the memory speed requirement is reduced.

14 Claims, 5 Drawing Sheets

(56) References Cited

U.S. PATENT DOCUMENTS

2016/0125787 A1* 5/2016 Pyeon ..... G09G 3/2022
345/691
2016/0148582 A1* 5/2016 Chung ..... G09G 3/3611
345/89

* cited by examiner

MURA COMPENSATION METHOD FOR DISPLAY PANEL

BACKGROUND OF THE INVENTION

1. Field of the Invention

The present invention relates to the field of display, and in particular to a Mura compensation method for display panel.

2. The Related Arts

In the rapid development of display technology, the liquid crystal display (LCD) and organic light-emitting diode (OLED) display have become the mainstream display technology, and thin, and are widely used in applications, such as, mobile phone, TV, personal digital assistant (PDA), digital camera, notebook PC, desktop PC, and so on.

Under the existing technical conditions, because of the poor raw materials, or the uncontrollable factors in actual manufacturing process, the problem of the presence of traces due to uneven brightness and when displaying an image, called Mura phenomenon, exists for some display panels.

The presence of Mura does not affect the function of the display pane, but will reduce the user's viewing comfort. Therefore, Mura phenomenon limits the development of the LCD display panels and OLED display panels. By raising the technology level or improving the raw material purity can reduce the probability of occurrence of Mura phenomenon. However, for existent display panels, the physical characteristics have been formed. The only approach is to compensate the image data signals inputted to different areas of the display panel, called de-Mura by the industry, to improve the Mura phenomenon so that the output image will be smooth to improve viewing comfort.

As shown in FIG. 1, the conventional Mura compensation method for display panel uses linear interpolation compensation method, comprising step 1: shifting the grayscale of the entire input image or picture downwards to reserve space for compensating the Mura phenomenon; Step 2: obtaining luminance information of a plurality of grayscale through image console; as seen in FIG. 1, six grayscale luminance information are shown, comprising: grayscale 223 luminance information, grayscale 192 luminance information, grayscale 160 luminance information, grayscale 128 luminance information, grayscale 96 luminance information, and grayscale 64 luminance information, and every two adjacent grayscales define a grayscale zone; and Step 3: determining the grayscale zone the inputted original data signal falls within, calculating by linear interpolation to obtain the luminance information corresponding to the original data signal, which is called Mura value by industry.

Take the grayscale of the inputted original data signal being 140 as example, 140 falls within the grayscale zone between 128 and 160. The linear interpolation is process is as follows:

$$\frac{Y_{140}-Y_{128}}{X_{140}-X_{128}}=\frac{Y_{160}-Y_{128}}{X_{160}-X_{128}} \tag{1}$$

$$Y_{140}=\frac{Y_{160}-Y_{128}}{X_{160}-X_{128}}\times(X_{140}-X_{128})+Y_{128} \tag{2}$$

Wherein $Y_{160}$, $Y_{140}$, $Y_{128}$ represent respectively the Mura values of grayscale 160, grayscale 140, and grayscale 128; and $X_{160}$, $X_{140}$, $X_{128}$ represent respectively grayscale 160, grayscale 140, and grayscale 128.

Take the inputted original data information grayscale being 30 as example, 30 falls within the grayscale zone between 0 and 64 and the linear interpolation is process is as follows:

$$Y_{30}=\frac{X_{30}}{X_{64}}\times Y_{64} \tag{3}$$

Wherein $Y_{30}$, $Y_{64}$ represent respectively the Mura values of grayscale 30 and grayscale 64; and $X_{30}$, $X_{64}$ represent respectively grayscale 30 and grayscale 64.

The advantage of using the traditional linear interpolation method to calculate Mura compensation for display panel is easiness of calculation and implementation. The disadvantage is, on one hand, the in effective compensation on the static image and low grayscale compensation ineffective; and on the other hand, because grayscale luminance information obtained from image console must be stored and process, the high processing speed memory (DDR) is required for compensating the HD images or pictures.

SUMMARY OF THE INVENTION

The object of the present invention is to provide a Mura compensation method for display panel, using different compensation calculation approaches for low grayscale, static and dynamic images, so as to improve the compensation effectiveness on the static image and low grayscale image and reduce the speed requirements on the memory (DDR).

To achieve the above object, the present invention provides a Mura compensation method for display panel, which comprises the steps of: Step S1: shifting a plurality of grayscales of an entire inputted image or picture downwards to reserve space for Mura compensation; Step S2: obtaining luminance information of a grayscale b other than the lowest grayscale from the inputted through an image console, i.e., Mura value; Step S3: obtaining luminance information of 0 to the lowest grayscale from the inputted through an image console, and generating an index table for Mura values for 0 to the lowest grayscale; Step S4: using the Mura value of grayscale b obtained in Step S2 and using linearly interpolation algorithm to calculate the Mura values for the remaining grayscales; Step S5: determining whether the inputted data signal being smaller than the lowest grayscale; if so, proceeding to Step S6; otherwise, proceeding to Step S7; Step S6: searching the index table for Mura value to perform Mura compensation to make the compensated grayscale larger than the lowest grayscale; and Step S7: determining whether the inputted data signal being dynamic image; if so, using linear interpolation algorithm to calculate the Mura value corresponding to the inputted data signal; otherwise, using non-linear interpolation algorithm to calculate the Mura value corresponding to the inputted data signal.

In Step S1, the plurality of grayscales of an entire inputted image or picture is shifted downwards by 32 grayscales, and the shifted grayscales are grayscales 223, grayscale 192, grayscale 160, grayscale 128, grayscale 96 and grayscale 64.

In Step S4, the linear interpolation algorithm used to calculate the Mura values of the remaining grayscales is:

$$\frac{Y_a}{Y_b}=\frac{X_a}{X_b}$$

Wherein $X_b$ is grayscale b, $X_a$ is any grayscale of the remaining grayscales; $Y_b$ is the Mura value corresponding to grayscale b, and $Y_a$ is the Mura value corresponding to any grayscale of the remaining grayscales.

In Step S7, the determination of whether the inputted data signal is a dynamic image is accomplished by comparing the inputted data signal and a plurality of pre-stored data, and the comparison result is the same, the inputted data signal is determined to be a static image, otherwise, a dynamic image.

In Step S7, the linear interpolation algorithm used to calculate the Mura values of the remaining grayscales is:

$$\frac{Y_c - Y_{i-1}}{X_c - X_{i-1}} = \frac{Y_i - Y_{i-1}}{X_i - X_{i-1}}$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

In Step S7, the non-linear interpolation algorithm used to calculate the Mura values of the remaining grayscales is:

$$\frac{Y_c - Y_{i-1}}{Y_i - Y_{i-1}} = \left(\frac{X_c - X_{i-1}}{X_i - X_{i-1}}\right)^2$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

The grayscale b is the grayscale 128.

The lowest grayscale is grayscale 64.

The present invention also provides a Mura compensation method for display panel, which comprises the steps of: Step S1: shifting a plurality of grayscales of an entire inputted image or picture downwards to reserve space for Mura compensation; Step S2: obtaining luminance information of a grayscale b other than the lowest grayscale from the inputted through an image console, i.e., Mura value; Step S3: obtaining luminance information of 0 to the lowest grayscale from the inputted through an image console, and generating an index table for Mura values for 0 to the lowest grayscale; Step S4: using the Mura value of grayscale b obtained in Step S2 and using linearly interpolation algorithm to calculate the Mura values for the remaining grayscales; Step S5: determining whether the inputted data signal being smaller than the lowest grayscale; if so, proceeding to Step S6; otherwise, proceeding to Step S7; Step S6: searching the index table for Mura value to perform Mura compensation to make the compensated grayscale larger than the lowest grayscale; and Step S7: determining whether the inputted data signal being dynamic image; if so, using linear interpolation algorithm to calculate the Mura value corresponding to the inputted data signal; otherwise, using non-linear interpolation algorithm to calculate the Mura value corresponding to the inputted data signal; wherein in Step S1, the plurality of grayscales of an entire inputted image or picture is shifted downwards by 32 grayscales, and the shifted grayscales are grayscales 223, grayscale 192, grayscale 160, grayscale 128, grayscale 96 and grayscale 64; wherein in Step S4, the linear interpolation algorithm used to calculate the Mura values of the remaining grayscales is:

$$\frac{Y_a}{Y_b} = \frac{X_a}{X_b}$$

Wherein $X_b$ is grayscale b, $X_a$ is any grayscale of the remaining grayscales; $Y_b$ is the Mura value corresponding to grayscale b, and $Y_a$ is the Mura value corresponding to any grayscale of the remaining grayscales.

Compared to the known techniques, the present invention provides the following advantages: the present invention provides a Mura compensation method for display panel, which only needs to extract the luminance information of a grayscale b other than the lowest grayscale from the inputted image through an image console, generates a Mura value index table for 0 to the lowest grayscale; uses linearly interpolation calculate the Mura values for the remaining grayscales; determines the inputted data signal; for low grayscale image smaller than the lowest grayscale, searches the index table for Mura value to perform Mura compensation to make the compensated grayscale larger than the lowest grayscale; for dynamic image, uses linear interpolation to calculate the Mura value corresponding to the inputted data signal; and for static image, uses non-linear interpolation to calculate the Mura value corresponding to the inputted data signal. As such, the Mura compensation effect is improved for static and low grayscale images; moreover, the memory speed requirement is reduced.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

To further explain the technical means and effect of the present invention, the following refers to embodiments and drawings for detailed description.

Figure 1:
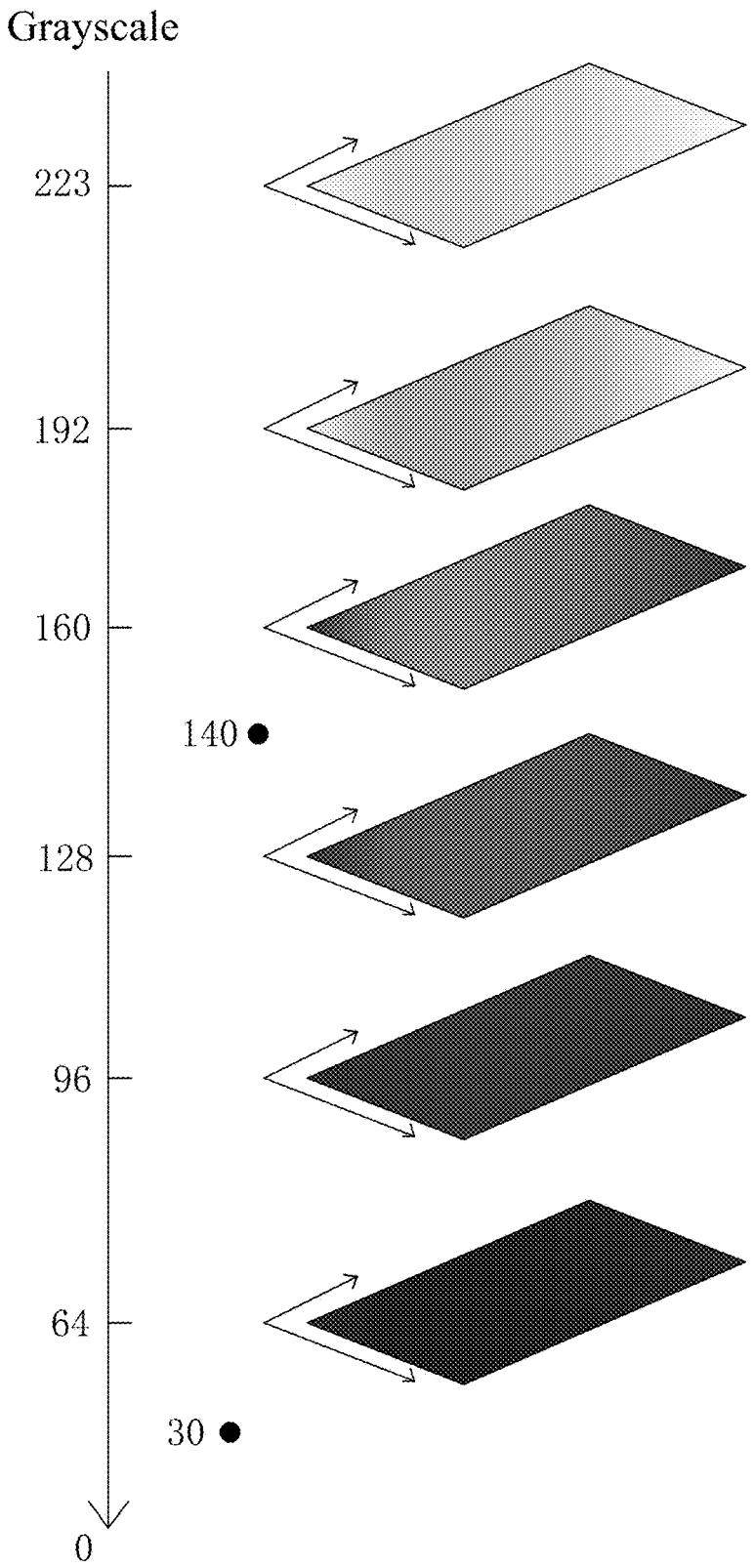
FIG. 1 is a schematic view showing a known Mura compensation method using linear interpolation for display panel.
Figure 2:
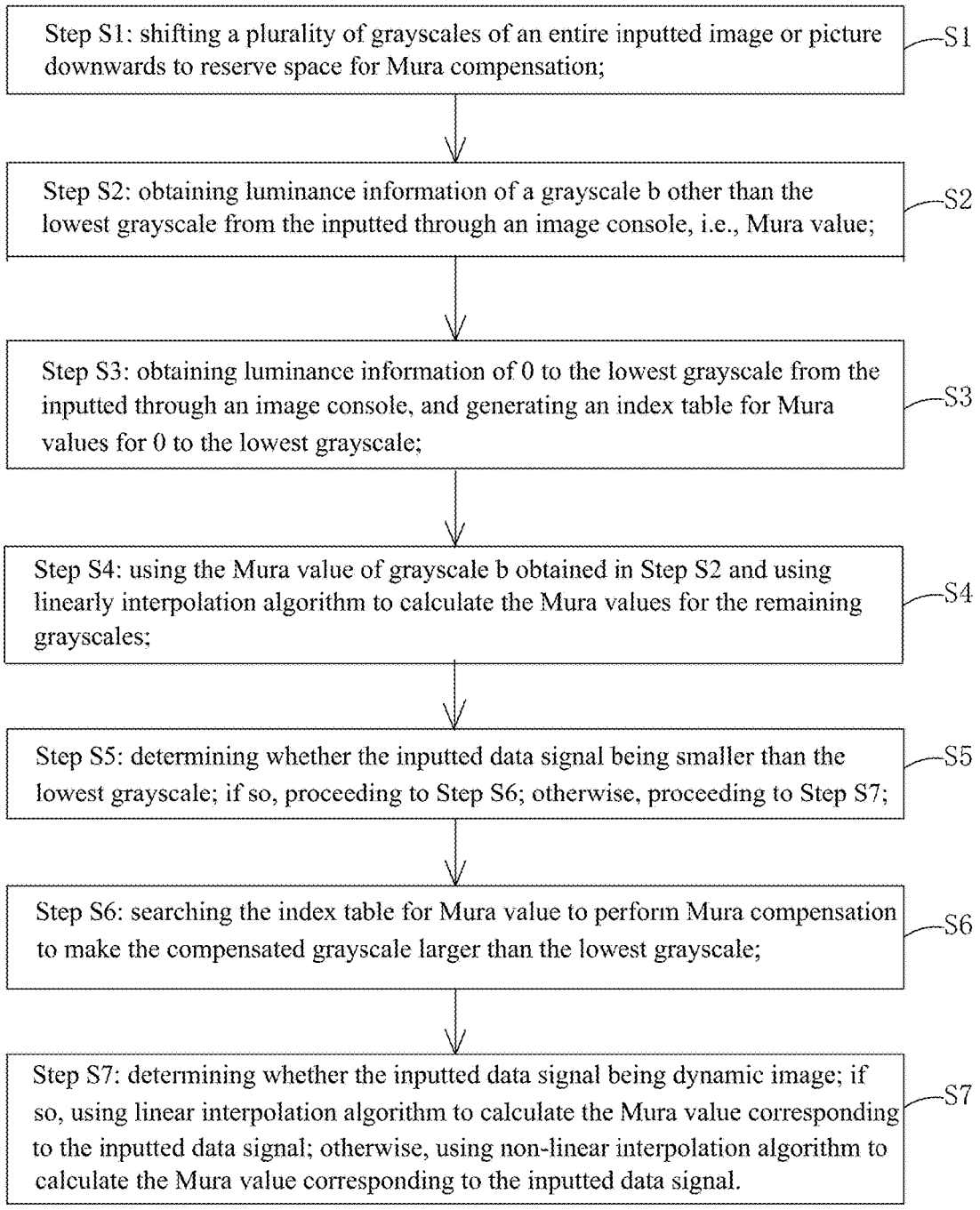
FIG. 2 is a schematic view showing the flowchart of the Mura compensation method for display panel provided by an embodiment of the present invention.
Figure 3:
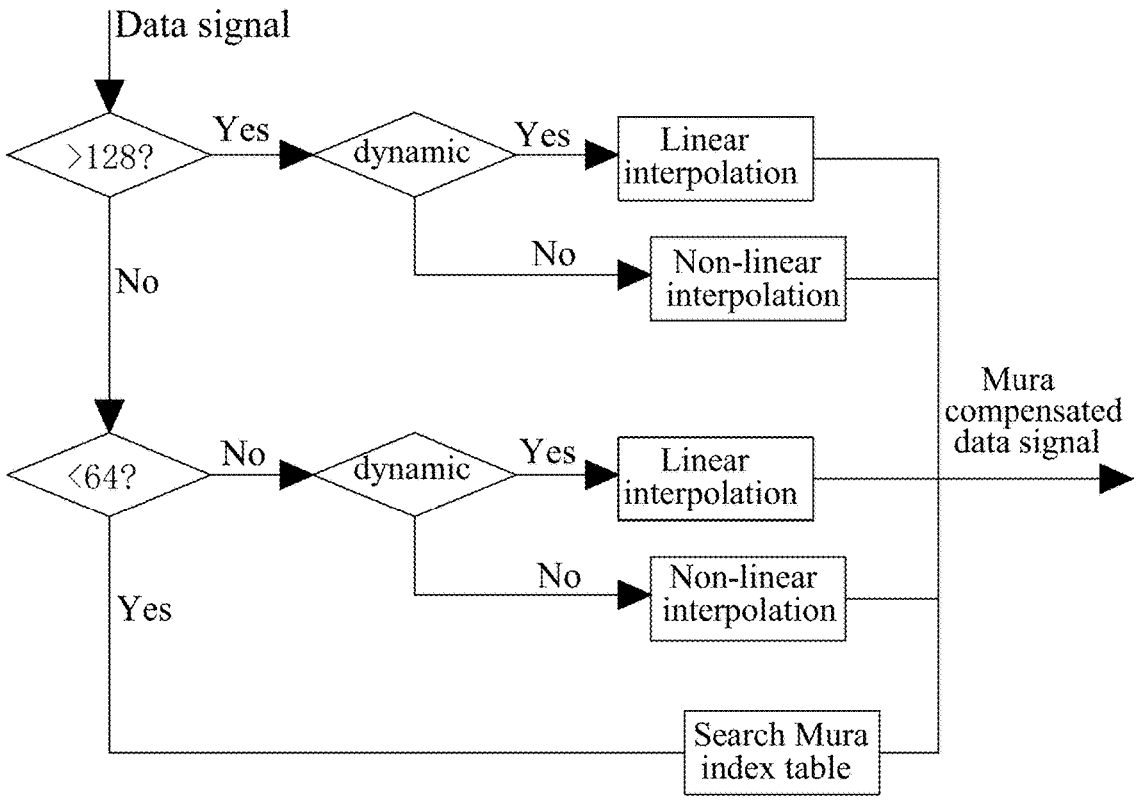
FIG. 3 is a schematic view showing the simplified flowchart of Step S5 to Step S7 of the Mura compensation method for display panel provided by an embodiment of the present invention.

Refer to FIG. 2 and FIG. 3. The present invention provides a Mura compensation method for display panel, which comprises the following steps:

Step S1: shifting a plurality of grayscales of an entire inputted image or picture downwards to reserve space for Mura compensation.

Specifically, as an exemplar, in Step S1, the plurality of grayscales of an entire inputted image or picture is shifted downwards by 32 grayscales, and the shifted grayscales are grayscales 223, grayscale 192, grayscale 160, grayscale 128, grayscale 96 and grayscale 64.

Step S2: obtaining luminance information of a grayscale b other than the lowest grayscale from the inputted through an image console, i.e., Mura value.

Figure 4:
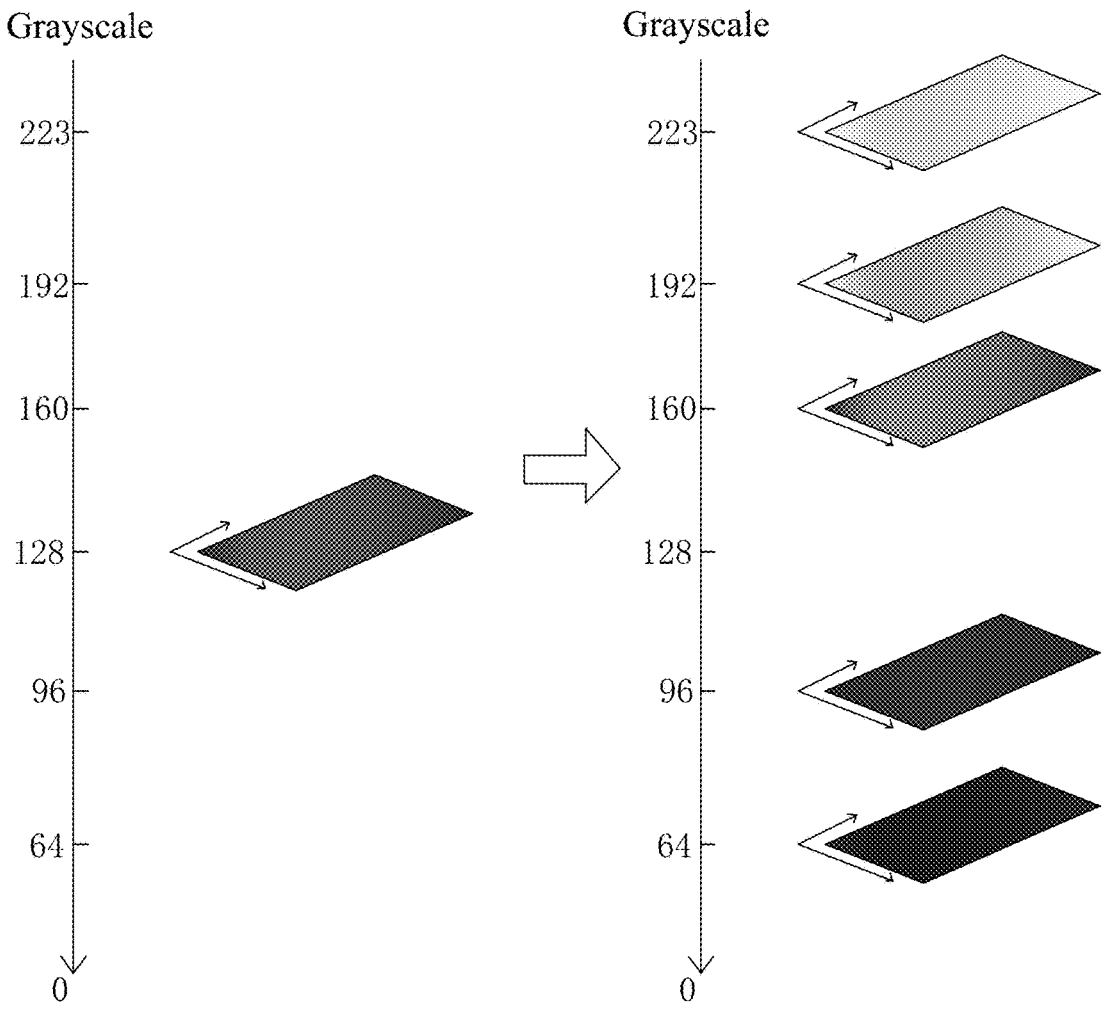
FIG. 4 is a schematic view showing using Mura value of grayscale 128 to calculate the Mura values of the remaining grayscales in the Mura compensation method for display panel provided by an embodiment of the present invention.

Specifically, as shown in FIG. 4, as an exemplar, step S2 obtains the luminance information of grayscale 128 other than the lowest grayscale 64 from the inputted through an image console. Compared with known technology which needs to obtain the luminance information of all the grayscales through the image console, this step only need to obtain the luminance information of one grayscale b other than the lowest grayscale. As such, the memory (DDR) speed requirement is also reduced.

Step S3: obtaining luminance information of 0 to the lowest grayscale from the inputted through an image console, and generating an index table for Mura values for 0 to the lowest grayscale.

Specifically, following the exemplar in the early step, step S3 obtains luminance information of 0 to the grayscale 64 from the inputted through an image console, and generates an index table for Mura values for 0 to the grayscale 64.

Step S4: using the Mura value of grayscale b obtained in Step S2 and using linearly interpolation algorithm to calculate the Mura values for the remaining grayscales.

Moreover, in Step S4, the linear interpolation algorithm used to calculate the Mura values of the remaining grayscales is:

$$\frac{Y_a}{Y_b} = \frac{X_a}{X_b}$$

Wherein $X_b$ is grayscale b, $X_a$ is any grayscale of the remaining grayscales; $Y_b$ is the Mura value corresponding to grayscale b, and $Y_a$ is the Mura value corresponding to any grayscale of the remaining grayscales.

Specifically, as shown in FIG. 4, following the exemplar in the above step, to calculate the Mura value corresponding to grayscale 160, the following equation is used:

$$\frac{Y_{160}}{Y_{128}} = \frac{X_{160}}{X_{128}}$$

Finally, $$Y_{160} = \frac{X_{160}}{X_{128}} \times Y_{128}$$

is obtained.

Similarly, to calculate the Mura value corresponding to grayscale 160, the following equation is used:

$$\frac{Y_{223}}{Y_{128}} = \frac{X_{223}}{X_{128}}$$

Finally, $$Y_{223} = \frac{X_{223}}{X_{128}} \times Y_{128}$$

is obtained.

By using the linear interpolation algorithm, the corresponding Mura values of the remaining five grayscales (i.e., grayscale 64, grayscale 90, grayscale 160, grayscale 192, and grayscale 223) other than grayscale 128 can be obtained.

Step S5: determining whether the inputted data signal being smaller than the lowest grayscale; if so, proceeding to Step S6; otherwise, proceeding to Step S7.

Specifically, following the exemplar in the above step, as shown in FIG. 3, step S5 determines whether the inputted data signal being smaller than the grayscale 64; if so, proceeding to Step S6; otherwise, proceeding to Step S7.

Step S6: searching the index table for Mura value to perform Mura compensation to make the compensated grayscale larger than the lowest grayscale.

Specifically, following the exemplar in the above step, as shown in FIG. 3, step S6 searches the index table for Mura value to perform Mura compensation to make the compensated grayscale larger than the grayscale 64.

Step S7: determining whether the inputted data signal being dynamic image; if so, using linear interpolation algorithm to calculate the Mura value corresponding to the inputted data signal; otherwise, using non-linear interpolation algorithm to calculate the Mura value corresponding to the inputted data signal.

Moreover, in Step S7, the determination of whether the inputted data signal is a dynamic image is accomplished by comparing the inputted data signal and a plurality of prestored data, and the comparison result is the same, the inputted data signal is determined to be a static image, otherwise, a dynamic image.

In Step S7, the linear interpolation algorithm used to calculate the Mura values of the remaining grayscales is:

$$\frac{Y_c - Y_{i-1}}{X_c - X_{i-1}} = \frac{Y_i - Y_{i-1}}{X_i - X_{i-1}}$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

Figure 5:
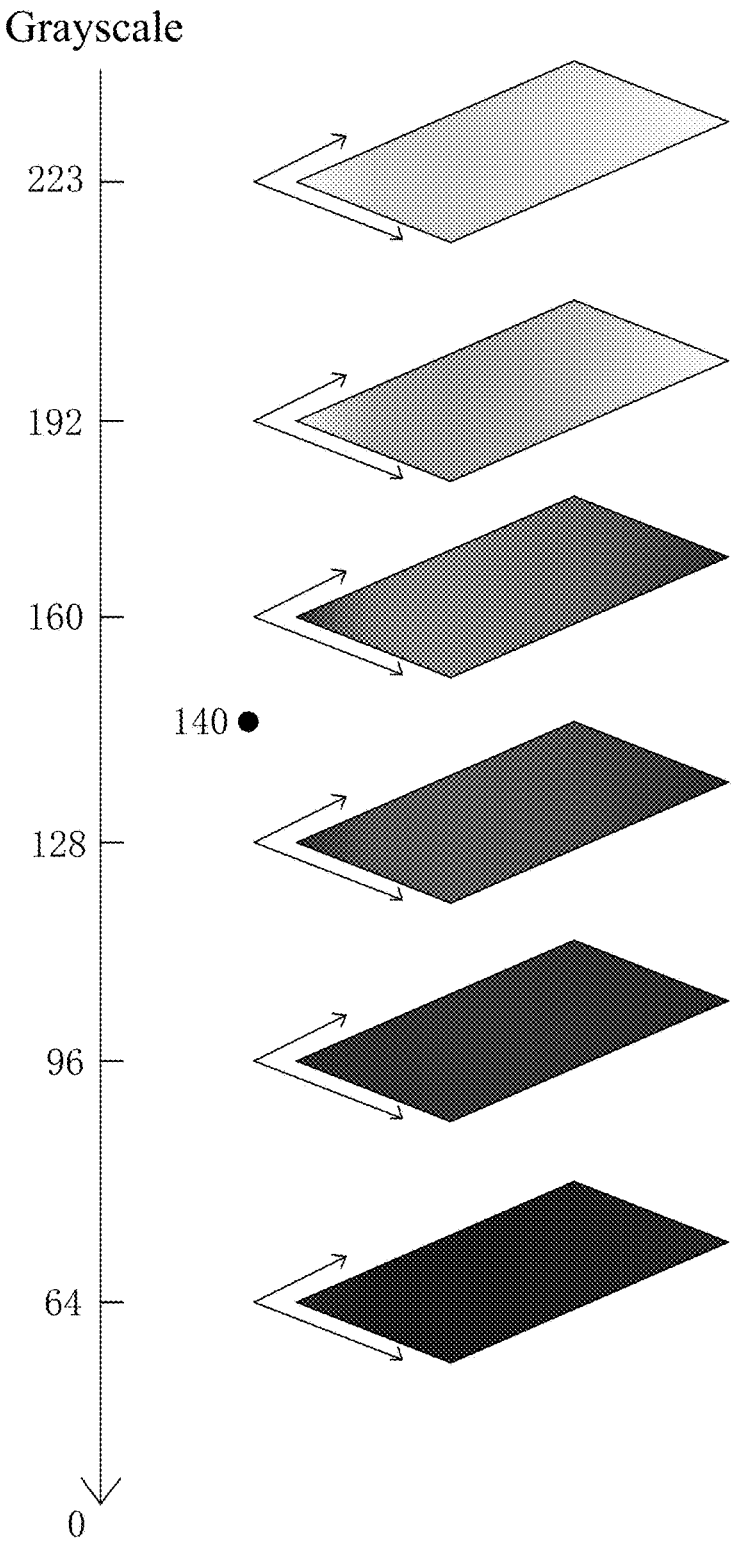
FIG. 5 is a schematic view showing obtaining the Mura value corresponding to the inputted data signal in the Mura compensation method for display panel provided by an embodiment of the present invention.

Specifically, following the exemplar in the above step and referring to FIG. 3 and FIG. 5, assume that the grayscale value of the inputted data signal is 140, which falls within the grayscale zone between 128 and 160. To calculate the Mura value corresponding to the grayscale 140 in the dynamic image, the following equation is used:

$$\frac{Y_{140} - Y_{128}}{X_{140} - X_{128}} = \frac{Y_{160} - Y_{128}}{X_{160} - X_{128}}$$

Finally, $$Y_{140} = \frac{Y_{160} - Y_{128}}{X_{160} - X_{128}} \times (X_{140} - X_{128}) + Y_{128}$$

is obtained.

In Step S7, the non-linear interpolation algorithm used to calculate the Mura values of the remaining grayscales is:

$$\frac{Y_c - Y_{i-1}}{Y_i - Y_{i-1}} = \left(\frac{X_c - X_{i-1}}{X_i - X_{i-1}}\right)^2$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

Specifically, following the exemplar in the above step and referring to FIG. 3 and FIG. 5, assume that the grayscale value of the inputted data signal is 140, which falls within the grayscale zone between 128 and 160. To calculate the Mura value corresponding to the grayscale 140 in the static image, the following equation is used:

$$\frac{Y_{140} - Y_{128}}{Y_{160} - Y_{128}} = \left(\frac{X_{140} - X_{128}}{X_{160} - X_{128}}\right)^2$$

Finally, $$Y_{140} = \left(\frac{X_{140} - X_{128}}{X_{160} - X_{128}}\right)^2 \times (Y_{160} - Y_{128}) + Y_{128}$$

is obtained.

The Mura values of the static image calculated by the non-linear interpolation algorithm will result in a graph approximating a gamma curve to make the luminance of the static image more uniform and smooth, and provide better compensation and better viewing experience.

In summary, the present invention provides a Mura compensation method for display panel, which only needs to extract the luminance information of a grayscale b other than the lowest grayscale from the inputted image through an image console, generates a Mura value index table for 0 to the lowest grayscale; uses linearly interpolation calculate the Mura values for the remaining grayscales; determines the inputted data signal; for low grayscale image smaller than the lowest grayscale, searches the index table for Mura value to perform Mura compensation to make the compensated grayscale larger than the lowest grayscale; for dynamic image, uses linear interpolation to calculate the Mura value corresponding to the inputted data signal; and for static image, uses non-linear interpolation to calculate the Mura value corresponding to the inputted data signal. As such, the Mura compensation effect is improved for static and low grayscale images; moreover, the memory speed requirement is reduced.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A Mura compensation method for display panel, which comprises the steps of:

Step S1: shifting a plurality of grayscales of an entire inputted image or picture downwards to reserve space for Mura compensation;

Step S2: obtaining luminance information of a grayscale b other than the lowest grayscale from the inputted through an image console, i.e., Mura value;

Step S3: obtaining luminance information of 0 to the lowest grayscale from the inputted through an image console, and generating an index table for Mura values for 0 to the lowest grayscale;

Step S4: using the Mura value of grayscale b obtained in Step S2 and using linearly interpolation algorithm to calculate the Mura values for the remaining grayscales;

Step S5: determining whether the inputted data signal being smaller than the lowest grayscale; if so, proceeding to Step S6; otherwise, proceeding to Step S7;

Step S6: searching the index table for Mura value to perform Mura compensation to make the compensated grayscale larger than the lowest grayscale; and Step S7: determining whether the inputted data signal being dynamic image; if so, using linear interpolation algorithm to calculate the Mura value corresponding to the inputted data signal; otherwise, using non-linear interpolation algorithm to calculate the Mura value corresponding to the inputted data signal.

2. The Mura compensation method for display panel as claimed in claim 1, wherein in Step S1, the plurality of grayscales of an entire inputted image or picture is shifted downwards by 32 grayscales, and the shifted grayscales are grayscales 223, grayscale 192, grayscale 160, grayscale 128, grayscale 96 and grayscale 64.

3. The Mura compensation method for display panel as claimed in claim 1, wherein in Step S4, the linear interpolation algorithm used to calculate the Mura values of the remaining grayscales is:

$$\frac{Y_a}{Y_b} = \frac{X_a}{X_b}$$

Wherein $X_b$ is grayscale b, $X_a$ is any grayscale of the remaining grayscales; $Y_b$ is the Mura value corresponding to grayscale b, and $Y_a$ is the Mura value corresponding to any grayscale of the remaining grayscales.

4. The Mura compensation method for display panel as claimed in claim 1, wherein in Step S7, the determination of whether the inputted data signal is a dynamic image is accomplished by comparing the inputted data signal and a plurality of pre-stored data, and the comparison result is the same, the inputted data signal is determined to be a static image, otherwise, a dynamic image.

5. The Mura compensation method for display panel as claimed in claim 1, wherein in Step S7, the linear interpolation algorithm used to calculate the Mura values of the remaining grayscales is:

$$\frac{Y_c - Y_{i-1}}{X_c - X_{i-1}} = \frac{Y_i - Y_{i-1}}{X_i - X_{i-1}}$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

6. The Mura compensation method for display panel as claimed in claim 1, wherein in Step S7, the non-linear interpolation algorithm used to calculate the Mura values of the remaining grayscales is:

$$\frac{Y_c - Y_{i-1}}{Y_i - Y_{i-1}} = \left(\frac{X_c - X_{i-1}}{X_i - X_{i-1}}\right)^2$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

7. The Mura compensation method for display panel as claimed in claim 1, wherein the grayscale b is the grayscale 128.

8. The Mura compensation method for display panel as claimed in claim 7, wherein the lowest grayscale is the grayscale 64.

9. A Mura compensation method for display panel, which comprises the steps of:

Step S1: shifting a plurality of grayscales of an entire inputted image or picture downwards to reserve space for Mura compensation;

Step S2: obtaining luminance information of a grayscale b other than the lowest grayscale from the inputted through an image console, i.e., Mura value;

Step S3: obtaining luminance information of 0 to the lowest grayscale from the inputted through an image console, and generating an index table for Mura values for 0 to the lowest grayscale;

Step S4: using the Mura value of grayscale b obtained in Step S2 and using linearly interpolation algorithm to calculate the Mura values for the remaining grayscales;

Step S5: determining whether the inputted data signal being smaller than the lowest grayscale; if so, proceeding to Step S6; otherwise, proceeding to Step S7;

Step S6: searching the index table for Mura value to perform Mura compensation to make the compensated grayscale larger than the lowest grayscale; and Step S7: determining whether the inputted data signal being dynamic image; if so, using linear interpolation algorithm to calculate the Mura value corresponding to the inputted data signal; otherwise, using non-linear interpolation algorithm to calculate the Mura value corresponding to the inputted data signal;

wherein in Step S1, the plurality of grayscales of an entire inputted image or picture is shifted downwards by 32 grayscales, and the shifted grayscales are grayscales 223, grayscale 192, grayscale 160, grayscale 128, grayscale 96 and grayscale 64;

wherein in Step S4, the linear interpolation algorithm used to calculate the Mura values of the remaining grayscales is:

$$\frac{Y_a}{Y_b} = \frac{X_a}{X_b}$$

Wherein $X_b$ is grayscale b, $X_a$ is any grayscale of the remaining grayscales; $Y_b$ is the Mura value corresponding to grayscale b, and $Y_a$ is the Mura value corresponding to any grayscale of the remaining grayscales.

10. The Mura compensation method for display panel as claimed in claim 9, wherein in Step S7, the determination of whether the inputted data signal is a dynamic image is accomplished by comparing the inputted data signal and a plurality of pre-stored data, and the comparison result is the same, the inputted data signal is determined to be a static image, otherwise, a dynamic image.

11. The Mura compensation method for display panel as claimed in claim 9, wherein in Step S7, the linear interpolation algorithm used to calculate the Mura values of the remaining grayscales is:

$$\frac{Y_c - Y_{i-1}}{X_c - X_{i-1}} = \frac{Y_i - Y_{i-1}}{X_i - X_{i-1}}$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

12. The Mura compensation method for display panel as claimed in claim 9, wherein in Step S7, the non-linear interpolation algorithm used to calculate the Mura values of the remaining grayscales is:

$$\frac{Y_c - Y_{i-1}}{Y_i - Y_{i-1}} = \left(\frac{X_c - X_{i-1}}{X_i - X_{i-1}}\right)^2$$

Wherein $X_c$ is the grayscale value corresponding to the inputted data signal, $X_{i-1}$ and $X_i$ are two adjacent grayscales; grayscale value corresponding to the inputted data signal falls within the grayscale zone formed by the two adjacent grayscales; $Y_c$ is the Mura value corresponding to the inputted data signal, and $Y_{i-1}$ and $Y_i$ are the Mura values corresponding to the two adjacent grayscales.

13. The Mura compensation method for display panel as claimed in claim 9, wherein the grayscale b is the grayscale 128.

14. The Mura compensation method for display panel as claimed in claim 13, wherein the lowest grayscale is the grayscale 64.

* * * * *